US008261672B2

(12) United States Patent
Heinisch et al.

(10) Patent No.: US 8,261,672 B2
(45) Date of Patent: Sep. 11, 2012

(54) VEHICLE FRONT-END MODULE FOR MOUNTING TO THE FRONT END OF A RAIL-BORNE VEHICLE, IN PARTICULAR A RAILWAY VEHICLE

(75) Inventors: Andreas Heinisch, Rethen (DE); Reiner Krause, Isernhagen (DE); Sascha Ende, Eschershausen (DE); Uwe Beika, Lübbenau (DE)

(73) Assignee: Voith Patent GmbH, Heidenheim (DE)

( * ) Notice: Subject to any disclaimer, the term of this patent is extended or adjusted under 35 U.S.C. 154(b) by 266 days.

(21) Appl. No.: 12/585,433

(22) Filed: Sep. 15, 2009

(65) Prior Publication Data

US 2010/0064931 A1 Mar. 18, 2010

(30) Foreign Application Priority Data

Sep. 15, 2008 (EP) ..... 08164337

(51) Int. Cl.
*B61D 15/06* (2006.01)

(52) U.S. Cl. ..... 105/392.5; 105/456; 296/190.03; 213/220

(58) Field of Classification Search ..... 105/392.5, 105/396, 421, 456; 188/371, 374, 377; 296/184.1, 296/190.01, 190.03, 190.08; 293/133; 213/220, 213/221, 222, 7, 75 R
See application file for complete search history.

(56) References Cited

U.S. PATENT DOCUMENTS 5,579,699 A * 12/1996 Dannawi et al. ..... 105/416
6,167,815 B1 * 1/2001 Werner et al. ..... 105/392.5
6,308,809 B1 * 10/2001 Reid et al. ..... 188/377
6,431,083 B1 8/2002 Carstensen et al.
6,561,105 B2 * 5/2003 Godin et al. ..... 105/396
6,951,176 B2 * 10/2005 Taguchi ..... 105/392.5
7,537,127 B2 * 5/2009 Hogbring ..... 213/62 R
2003/0090129 A1 5/2003 Riley et al.
2003/0227190 A1 * 12/2003 Okamoto et al. ..... 296/84.1
2004/0159263 A1 8/2004 Yamamoto et al.

(Continued)

FOREIGN PATENT DOCUMENTS

DE 19649526 6/1998

(Continued)

*Primary Examiner* — S. Joseph Morano
*Assistant Examiner* — Zachary Kuhfuss
(74) *Attorney, Agent, or Firm* — Jean C. Edwards, Esq.; Edwards Neils PLLC

(57) ABSTRACT

The invention relates to a vehicle front-end module having a vehicle front-end structure (100) for mounting to the front end of a rail-borne vehicle, in particular a railway vehicle, wherein the vehicle front-end structure (100) is wholly composed of structural elements made from fiber composite or fiber composite sandwich material. The structural elements forming the vehicle front-end structure (100) comprise first structural elements (10, 10', 11, 12, 12', 14, 15, 16) which are configured and directly connected to one another so as to form a substantially deformation-resistant, self-supporting front-end structure designed to accommodate a vehicle driver's cab (101). The structural elements forming the vehicle front-end structure (100) further comprise second structural elements (20, 20', 21, 21', 22, 22', 23, 24, 24') connected to the first structural elements (10, 10', 11, 12, 12', 14, 15, 16) and designed such that at least a portion of the impact energy occurring due to the transmitting of impact force (collision energy) and introduced into the structure (100) upon a collision of the rail-borne vehicle is dissipated by at least partly irreversible deformation or at least partial destruction of the second structural elements (20, 20', 21, 21', 22, 22', 23, 24, 24').

32 Claims, 15 Drawing Sheets

U.S. PATENT DOCUMENTS

Figure 1:
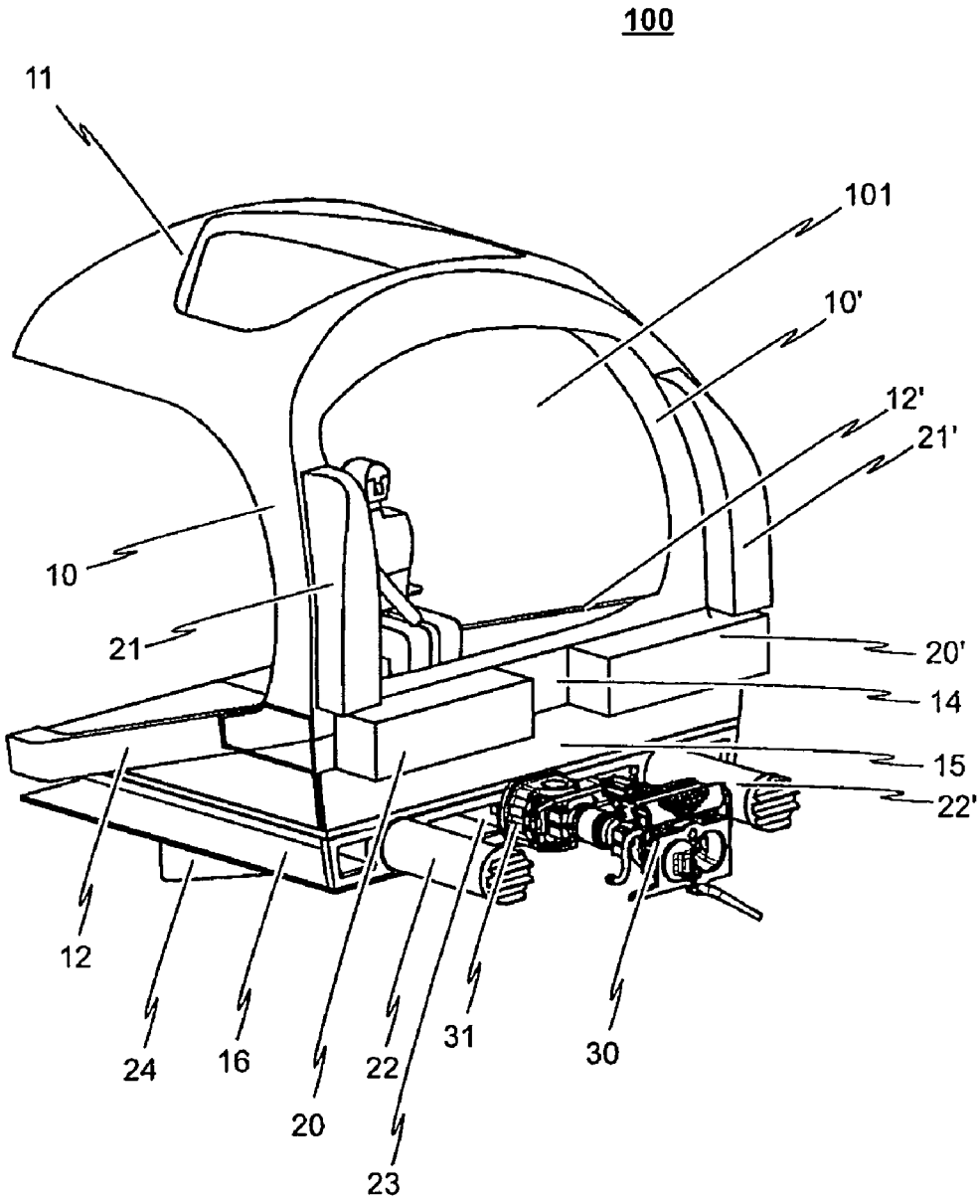

| | | | | |
|---|---|---|---|---|
| 2005/0186415 | A1 * | 8/2005 | McCormick et al. | 428/336 |

FOREIGN PATENT DOCUMENTS

| | | | | |
|---|---|---|---|---|
| DE | 197 25 905 | A1 | | 12/1998 |
| EP | 0533582 | | | 3/1993 |
| EP | 0802100 | | | 10/1997 |
| EP | 0 888 946 | A1 | | 1/1999 |
| FR | 2715904 | A | | 8/1995 |
| GB | 2411630 | | | 9/2005 |
| GB | 2411631 | | | 9/2005 |
| GB | 2411632 | | | 9/2005 |
| GB | 2411633 | | | 9/2005 |
| WO | WO2004026656 | | * | 4/2004 |

* cited by examiner

VEHICLE FRONT-END MODULE FOR MOUNTING TO THE FRONT END OF A RAIL-BORNE VEHICLE, IN PARTICULAR A RAILWAY VEHICLE

The present invention relates to a vehicle front-end module having a frame for mounting to the front end of a rail vehicle, wherein the frame is wholly composed of structural elements made from fiber-reinforced plastic.

A frame for a vehicle cabin of a rail vehicle is know from the GB 2 411 630 A printed publication, wherein the frame is comprised of frame elements which define the front, base and roof portions as well as the side portions of the vehicle cabin. This known prior art frame exhibits a plurality of yielding regions distributed in the frame members. In the event of a crash; i.e. should a rail vehicle equipped with the vehicle front-end module known from this prior art collide with another rail vehicle or with another type of obstacle, the yielding regions give way so that the frame can adapt to the shape of the obstacle collided with, whereby the impact energy introduced into the frame from the collision can be at least partly dissipated.

On the other hand, a cabin for a rail vehicle is known from the EP 0 533 582 A1 printed publication, whereby this cabin is not affixed to the front end of the rail vehicle but rather mounted on a horizontal platform. Since this known prior art cabin is made completely from fiber-reinforced plastic for reasons of weight, equipping the cabin itself with a shock absorber to absorb the energy occurring in a crash has been dispensed with. Instead, such a shock absorber has been integrated into the undercarriage, the platform respectively, on which the cabin is mounted.

The DE 196 49 526 A1 printed publication describes a vehicle front-end module designed to be affixed to the front end of a rail vehicle, wherein the walls and the roof of the vehicle front-end module are composed of a composite material for reasons of weight and detachably connected to the undercarriage and the car body of the rail vehicle. This known prior art front-end module—as well as the cabin known from EP 0 533 582 B2—is designed without a shock absorber.

Shock absorbers are so-called crash structures; i.e. components which at least partly deform in a predetermined way upon the vehicle colliding with an obstacle. The impact energy is to thereby be selectively converted, preferably into deformation energy, in order to reduce the accelerations and forces acting on the passengers.

Providing a shock absorber in the form of a crumple zone is known in the field of automotive technology, particularly in the front area of a passenger car. While the automobile industry has sought to optimize such crash structures for decades, the car bodies in rail vehicle technology (locomotives and rail cars) have to date usually been constructed without much consideration paid to their deformation behavior during collisions.

While arranging a side buffer element or crash boxes on the front end of a rail vehicle to serve as a shock absorber is common, these elements absorbing or dissipating at least a portion of the impact energy in the event of a crash, the energy absorption attainable with such a shock absorber is often not sufficient at higher impact speeds to effectively protect the car body from damage. There is in particular the risk that after the energy-absorbing capacity of the side buffer elements or crash boxes has been exhausted, there will be extreme deformation of the driver's cab and/or the car body structure in the area of the passenger compartment, whereby sufficient survival space for the train personnel and the passengers may no longer be able to be guaranteed.

The invention is thus based on the task of optimizing a vehicle front-end module designed to be mounted to the front end of a rail vehicle such that in the event of a crash, the impact energy acting on the vehicle front-end can be dissipated to the greatest extent possible by the vehicle front-end module structure in order to limit the maximum accelerations and forces on the vehicle structure with the objective of ensuring survival space for the driver in the event of a crash, whereby an uncontrolled deforming of the structure is to be effectively prevented.

This task is solved by the inventive vehicle front-end module. Advantageous further developments of the inventive vehicle front-end module are set forth in the dependent claims.

Thus, in order to improve the crash behavior of rail vehicles, the invention proposes a vehicle front-end module wholly made of structural elements primarily made from fiber-reinforced plastic. Specifically, among the structural elements forming the vehicle front-end module structure are structural elements which do not absorb energy, referred to hereinafter as "first structural elements," as well as structural elements which do absorb energy, referred to herein-after as "second structural elements." All the structural elements serving the construction of a substantially deformation-resistant, self-supporting vehicle constitute the non-energy-absorbing structural elements, i.e. the first structural elements. This substantially rigid, self-supporting structure houses the driver's cab of the rail vehicle. Because the driver's cab is surrounded by a front-end structure resistant to deformation, one which will also not significantly deform in the event of a crash, the conductor's survival space in the vehicle front-end module remains viable.

On the other hand, the energy-absorbing structural elements, i.e. the second structural elements, functionally serve to at least partly absorb or dissipate the impact energy introduced into the vehicle front-end module by the impact energy transmitted during a crash such that the self-supporting structure of the vehicle front-end module composed of the first structural elements is not affected. The second structural elements are preferably mounted to the self-supporting structure of the vehicle front-end module composed of the first structural elements. In particular, the second structural elements are accommodated in the self-supporting structure such that they form one unit together with said self-supporting structure.

Since the structural elements (first and second structural elements) in the inventive solution are made wholly from fiber-reinforced plastic, it is particularly conceivable to join the second structural elements to the first structural elements in a material fit, for example with an adhesive bond. Accordingly, the second structural elements can be integrated into the self-supporting vehicle front-end module structure composed of the first structural elements, wherein the second structural elements are detachably or non-detachably accommodated in the first structural elements so as to form one unit having dual function; i.e. a supporting function, as provided by the first structural elements, as well as an energy-absorbing function, as provided by the second structural elements.

As noted above, the structural elements forming the vehicle front-end module structure are made completely from fiber-reinforced plastic. By using different fiber composite/fiber composite sandwich structures for the individual areas of the vehicle front-end module structure, it becomes conceivable to have the impact energy which occurs during a crash and which is introduced into the vehicle front-end module structure be selectively dissipated; i.e. absorbed.

Because the structural components forming the vehicle front-end module structure are almost completely made from fiber-reinforced plastic, the weight of more than just the vehicle front-end module structure can be considerably reduced compared to a vehicle front-end structure of metal construction. In fact, the structural elements made of fiber-reinforced plastic are moreover characterized by their specific rigidity so that the substantially deformation-resistant, self-supporting front-end vehicle structure composed of the first structural elements does not itself collapse upon a collision; i.e. deform uncontrollably, thereby guaranteeing that survival space will remain for the driver in the driver's cab.

Because the second structural components, which absorb at least part of the impact energy occurring in a crash and introduced into the vehicle front-end module structure, are likewise made of fiber-reinforced plastic, a substantially higher weight-specific energy absorption—compared to conventional deformation tubes made of metal—can be achieved. To this end, the invention provides for the second structural components to be designed so as to at least partly absorb the impact energy introduced into said second structural components by the non-ductile destruction of the fiber-reinforced plastic of said second structural components upon activation.

Since the self-supporting structure of the vehicle front-end module formed by the first structural elements is configured to be substantially resistant to deformation, a survival space remains in the driver's cab accommodated in the self-supporting front-end structure even upon a collision (crash) of the vehicle front-end module. In conjunction hereto, it is preferable for the first structural elements to be configured and connected together such that in the event of a crash, the portion of the impact energy introduced in the vehicle front-end module not already absorbed by the second structural elements is transmitted to a car body structure of the rail vehicle connected to the vehicle front-end module. The impact energy can then be ultimately absorbed there by the shock absorber elements of the car body structure of the rail vehicle.

In those cases in which the structurally-dimensioned maximum amount of energy absorption of the second structural elements is exceeded at higher collision speeds (collision energies), the first structural elements are structurally designed so as to controllably deform and thus have further energy absorption ensue without the (uncontrolled) collapsing of the vehicle front-end module structure.

In a preferred realization of the inventive solution for forming the substantially deformation-resistant, self-supporting vehicle front-end module, the first structural elements comprise two A pillars respectively arranged on the sides of the vehicle front-end module structure as well as a roof structure respectively connected to the upper areas of the two A pillars, whereby the A pillars and the roof structure firmly connected thereto are designed to transmit the portion of the impact energy introduced in the vehicle front-end module not already absorbed by the second structural elements to the car body structure of the rail vehicle connected to the vehicle front-end module in the event of a crash. It is furthermore conceivable here for the first structural elements to also comprise crosspieces which are respectively fixedly connected to the lower area of the two A pillars and which serve to transmit impact forces to the car body structure of the rail vehicle.

Alternatively or additionally to the above-cited embodiment which provides for crosspieces serving to transfer impact force from the two A pillars to the car body structure of the rail vehicle, it is conceivable to configure the respective A pillars to be, for example, curved, whereby a lower structural element is further provided which is fixedly connected to the upper end sections of the A pillars and designed to transmit the portion of the impact energy introduced in the A pillars not already absorbed by the second structural elements to the car body structure of the rail vehicle connected to the vehicle front-end module in the event of a crash. The curved design to the A pillars allows one to dispense with crosspieces.

Since the crosspieces, the A pillars respectively, are subjected to extreme forces during a crash, and uncontrolled deformation; i.e. collapse of these structural elements needs in particular be prevented, it is preferable for these structural elements to be comprised of a hollow profile formed from fiber-reinforced plastic which preferably accommodates a core material, in particular a foam core, to optionally further increase the rigidity.

On the other hand, with respect to the roof structure, it is preferred to manufacture same in a sandwich construction from a fiber-reinforced plastic. Of course, other solutions are also conceivable here.

In order to structurally connect the two A pillars to each other, and thus increase the rigidity to the frame structure formed from the first structural elements, it is preferable for the first structural elements to comprise at least one railing element to structurally connect the two A pillars together at the respective lower area of said A pillars. It is further preferred for the first structural elements to comprise a deformation-resistant end wall which is likewise formed from fiber-reinforced plastic and connected to the railing element such that the deformation-resistant end wall together with the railing element form an end face of the vehicle front-end module structure and thus protect the vehicle's driver cab accommodated in the self-supporting frame structure from intrusions. Hence, a collision front wall is provided which forms at least one section of the coupling-side end face of the vehicle front-end module structure, whereby the railing element and/or the end wall constitute an important structural member in the preventing of object penetration. This accordingly effectively prevents, in the event of a crash, components from penetrating the space formed by the self-supporting frame structure in which the vehicle driver's cab is accommodated. Of course, other flexural crossmember structures are also suited to forming such a collision front wall.

The end wall forming the collision front wall can preferably be made from different fiber-reinforced plastic/fiber-reinforced plastic sandwich components, particularly with the reinforcing materials of glass, aramid, Dyneema and/or carbon fiber. A fiber-reinforced sandwich construction is particularly conceivable here. Due to the structural arrangement and design of the "end wall" structural component, the end wall together with the railing element constitutes a decisive structural connecting element to stabilize the entire self-supporting structure of the vehicle front-end module.

As indicated above, the solution according to the invention is characterized among other things by second structural elements, i.e. energy-absorbing structural elements, being integrated in the (rigid) frame structure of the rail vehicle front-end module formed by the first structural elements. A preferred realization of the inventive vehicle front-end module thereby provides for these second structural elements to comprise at least one first energy-absorbing element made from fiber-reinforced plastic, whereby this first energy-absorbing element is designed to respond upon the exceeding of a critical impact force and at least partly absorb the impact energy occurring during the transmitting of impact force introduced into the first structural component by the non-ductile destruction of at least one part of the fiber structure of said first structural component. Because of the non-ductile destruction of the energy-absorbing element when the fiber-reinforced plastic absorbs energy, energy absorption ensues from the introduced impact energy being transformed into brittle fracture energy, wherein at least a portion of the fiber-reinforced plastic of the energy-absorbing element frays or is pulverized and the energy-absorbing element thus destroyed.

This mechanism of fraying and pulverizing is characterized by its high load factor upon energy absorption, whereby a clearly higher weight-specific and construction space-specific amount of energy—compared, for example, to a metal compression or deformation tube (expansion or reduction tube)—can be absorbed.

Various solutions are conceivable for the realizing of the first energy-absorbing element made from the fiber-reinforced plastic. It is particularly conceivable, for example, to use a fiber composite sandwich construction formed as core material in a honeycomb structure as the energy-absorbing element. This type of ideally homogeneous honeycomb structure with a uniform geometrical cross-section exhibits an even deformation of the material at low deformation force amplitudes with a concurrent high load and compression rate when absorbing energy. In particular, this type of energy-absorbing element can ensure the dissipating of the energy to be absorbed according to a predefinable sequence of events upon its activation. Of course, other embodiments of the first energy-absorbing element are also conceivable.

At least one first energy-absorbing element is preferably arranged on the front end of the railing element so that the deformation forces occurring during the energy absorption can be introduced into said railing element. In the process, the first energy-absorbing element is to be adapted to the vehicle contour, the available construction space respectively.

As previously stated, it is conceivable for the first energy-absorbing element to exhibit a fiber composite sandwich construction having a honeycomb structure. Alternatively hereto, of course, it is also possible to form the core of the first energy-absorbing element from a fiber composite tube bundle, whereby the central axis of the tubes of the tube bundle extend in the longitudinal direction of the vehicle.

Additionally to the at least one first energy-absorbing element, it is preferable for the second structural element to exhibit at least one second energy-absorbing element, likewise made from fiber-reinforced plastic, which in terms of its structure, can be configured identically to the at least one first energy-absorbing element. However, the at least one second energy-absorbing element is to be arranged on the surface of the A pillars facing the vehicle front-end module.

This special arrangement of the first and second energy-absorbing elements allows for different collision scenarios, whereby particularly the at least one second energy-absorbing element provided as part of the one A pillar allows for the impact forces occurring during relatively high collisions and introduced into the rail vehicle front-end module.

On the other hand, to protect the lower area of the rail vehicle front-end module, one preferred realization of the inventive solution provides for a specially-formed undercarriage structure which is connected to the first structural element forming the self-supporting structure of the rail vehicle front-end module so as to form the base of the vehicle front-end module.

It is conceivable here for the undercarriage structure to comprise an upper surface element made from fiber-reinforced plastic and a lower surface element likewise made from fiber-reinforced plastic spaced at a distance therefrom, wherein fiber-reinforced plastic struts or ribs are further provided to firmly connect the upper and lower surface elements together. It is hereby preferred to integrate further energy-absorbing structural elements (i.e. second structural elements) in this undercarriage structure. Conceivable here is that the second structural elements comprise at least one third energy-absorbing element made from fiber-reinforced plastic which is accommodated in the undercarriage structure of the vehicle front-end module and designed to respond upon the exceeding of a critical impact force and absorb at least part of the impact energy occurring during the transmission of impact forces and introduced into said third structural component by the non-ductile destruction of at least part of the fiber structure of said third energy-absorbing element.

When a central buffer coupling is provided for the vehicle front-end module, and articulated to the undercarriage structure of the vehicle front-end module via a bearing block, it is preferred for the second structural elements to further comprise at least one fourth energy-absorbing element made from fiber-reinforced plastic which, additionally to the at least one third energy-absorbing element, is arranged in the direction of impact in the undercarriage structure behind the bearing block and is designed to respond upon the exceeding of a critical impact force and absorb at least part of the impact energy occurring during the transmission of impact forces and introduced into said fourth energy-absorbing element by the non-ductile destruction of at least part of the fiber structure of said fourth energy-absorbing element.

The third and fourth energy-absorbing elements can be of identical or at least similar design in terms of their structure and function.

A preferred realization of the third/fourth energy-absorbing element provides for said third/fourth energy-absorbing element to comprise a guide tube made of fiber-reinforced plastic, i.e. for example a cylindrical energy-absorbing component, as well as a pressure tube configured as a plunger, wherein the pressure tube interacts with the guide tube such that upon the exceeding of the critical impact force introduced into the third/fourth energy-absorbing element, the pressure tube and the guide tube are moved relatively toward one another while simultaneously absorbing at least a portion of the impact energy introduced into said third/fourth energy-absorbing element. The actual energy absorption is thereby realized in that the guide tube comprises at least one energy-absorbing section made of fiber-reinforced plastic which at least partly frays and pulverizes in non-ductile manner upon the movement of the plunger-configured pressure tube relative to said guide tube.

As with the other energy-absorbing elements (first and second energy-absorbing elements) associated with the second structural elements, at least some of the introduced impact energy is thus absorbed by the energy-absorbing section of the guide tube not plastically deforming, as would be the case for example in a deformation tube of metal construction, but rather by being at least partly dispersed to individual components. In other words, when the third/fourth energy-absorbing element responds, the impact energy introduced into the energy-absorbing element is used to fray and pulverize the energy-absorbing section and is thus at least partly dissipated. Since the fraying and pulverizing of a component—compared to normal (metallic) plastic deformation—requires considerably more energy, the third/fourth energy-absorbing element is also particularly well-suited to dissipate high impact energies.

On the other hand, the high weight-specific energy-absorbing capacity of an energy-absorbing element made from fiber-reinforced plastic is characterized by its lightweight construction—compared to conventional energy-absorbing elements made of metal (e.g. deformation tubes)—such that the overall weight of the vehicle front-end module can be reduced considerably.

To be understood by the expression "fraying of the energy-absorbing section made of fiber-reinforced plastic" as used herein is an (intentionally induced) breakdown of the fiber structure of the fiber-reinforced plastic forming the energy-absorbing section. Fraying of the energy-absorbing section made of fiber-reinforced plastic is in particular not to be likened to only a (brittle) fracture occurring in the energy-absorbing section. Rather, the fraying breaks down the fiber-reinforced plastic of the energy-absorbing section into the smallest possible individual fractions (fragments), whereby to exhaust the entire energy-absorbing capacity of the fiber composite material, the entire amount of the fiber-reinforced plastic forming the energy-absorbing element is ideally pulverized.

In the preferred embodiment of the third/fourth energy-absorbing element, the pressure tube is configured—as indicated above—as a plunger and at least the section of the guide tube facing the pressure tube is configured as a cylinder, wherein the pressure tube configured as a plunger is connected to the guide tube such that upon the responding of the energy-absorbing element, the plunger (pressure tube) enters into the cylinder (guide tube) and thereby effects a non-ductile fraying of the energy-absorbing section made of fiber-reinforced plastic.

It is specifically conceivable for a section of the pressure tube facing the guide tube to be telescopically received in a section of the guide tube facing the pressure tube such that the front end of the pressure tube section facing the guide tube strikes against a stop of the fiber-reinforced plastic energy-absorbing section. This telescopic structure guarantees the guiding of the relative movement occurring between the pressure tube and the guide tube upon the energy-absorbing element being activated as well as the functioning and deformation behavior even in the event of transverse forces.

In order for the impact energy to only be absorbed by the fiber-reinforced plastic energy-absorbing section upon the activating of the third/fourth energy-absorbing element, the front end of the section of the pressure tube facing the guide tube should exhibit a higher rigidity than said fiber-reinforced plastic energy-absorbing section. This namely ensures that the movement of the pressure tube relative the guide tube occurring upon the activating of the (third/fourth) energy-absorbing element only results in destruction of the energy-absorbing section, wherein the other components of the energy-absorbing element do not rupture. This allows the energy absorption to follow a predefinable sequence of events.

In one preferred embodiment of the third/fourth energy-absorbing element, the pressure tube is designed as a hollow body open at its front end facing the guide tube. This accordingly allows the fractions of the energy-absorbing section formed from the fiber-reinforced plastic which develop upon the movement of the pressure tube relative the guide tube to be at least partly accommodated inside the hollow body.

This embodiment of the third/fourth energy-absorbing element thus provides a fully encapsulated external solution, wherein it is particularly ensured that upon the energy-absorbing element activating, no fragments such as fractions or fiber elements of the energy-absorbing section can fly around, penetrate into the vehicle driver's cab, and possibly injure persons or damage or even destroy other components of the vehicle front-end module.

As noted above, the preferred embodiment of the third/fourth energy-absorbing element thereby realizes an absorption of energy which, upon the activation of the energy-absorbing element, effects a non-ductile fraying of the fiber-reinforced plastic energy-absorbing section according to a predefined sequence of events. The length of the energy-absorbing section which frays in non-ductile manner upon the movement of the pressure tube relative the guide tube is thereby preferably contingent on the distance ensuing from the relative movement between the pressure tube and the guide tube.

A preferred further development of the inventive rail vehicle front-end module further provides for an underride or rail guard made of fiber-reinforced plastic. It is hereby conceivable for this underride guard to be affixed to the underside of the undercarriage structure of the rail vehicle front-end module and be designed to dissipate at least part of the impact energy occurring during the transmission of impact force upon the exceeding of a critical impact force introduced into the underride guard by controlled deformation.

Alternatively hereto, it is conceivable for the underride guard to be connected to the underside of the undercarriage structure via guide rails such that the underride guard is displaceable in the longitudinal direction of the vehicle relative the undercarriage structure upon the exceeding of a critical impact force introduced into said underride guard, wherein at least one energy-absorbing element made of fiber-reinforced plastic is further provided which is arranged and designed such that upon the underride guard displacing relative the undercarriage structure, the fiber-reinforced plastic of the energy-absorbing element is non-ductilely destroyed with the simultaneous absorbing of at least part of the impact energy introduced into said underride guard during the transmission of impact force.

To produce a crashworthy rail vehicle front-end module, it is further preferred to provide for a windscreen which preferably also exhibits an energy-absorbing function. It is hereby conceivable for the windscreen to comprise an inner and an outer transparent surface element, wherein these surface elements are arranged to be spaced apart from one another and form a gap between them. This gap can be filled with a connecting element between the outer and the inner surface element, for example in the form of a transparent energy-absorbing foam. It is likewise conceivable for the connecting element to be provided in an edge section of the gap between the surface elements. In this case, the edge section can be filled with less of the transparent energy-absorbing foam.

Of course, it is also conceivable for this type of windscreen energy absorption to be of a multi-layer construction; i.e. an arrangement of a plurality of superposed surface elements fixed at defined distances to connecting elements.

The following will reference the accompanying drawings in describing exemplary embodiments of the inventive rail vehicle front-end module.

Figure 2:
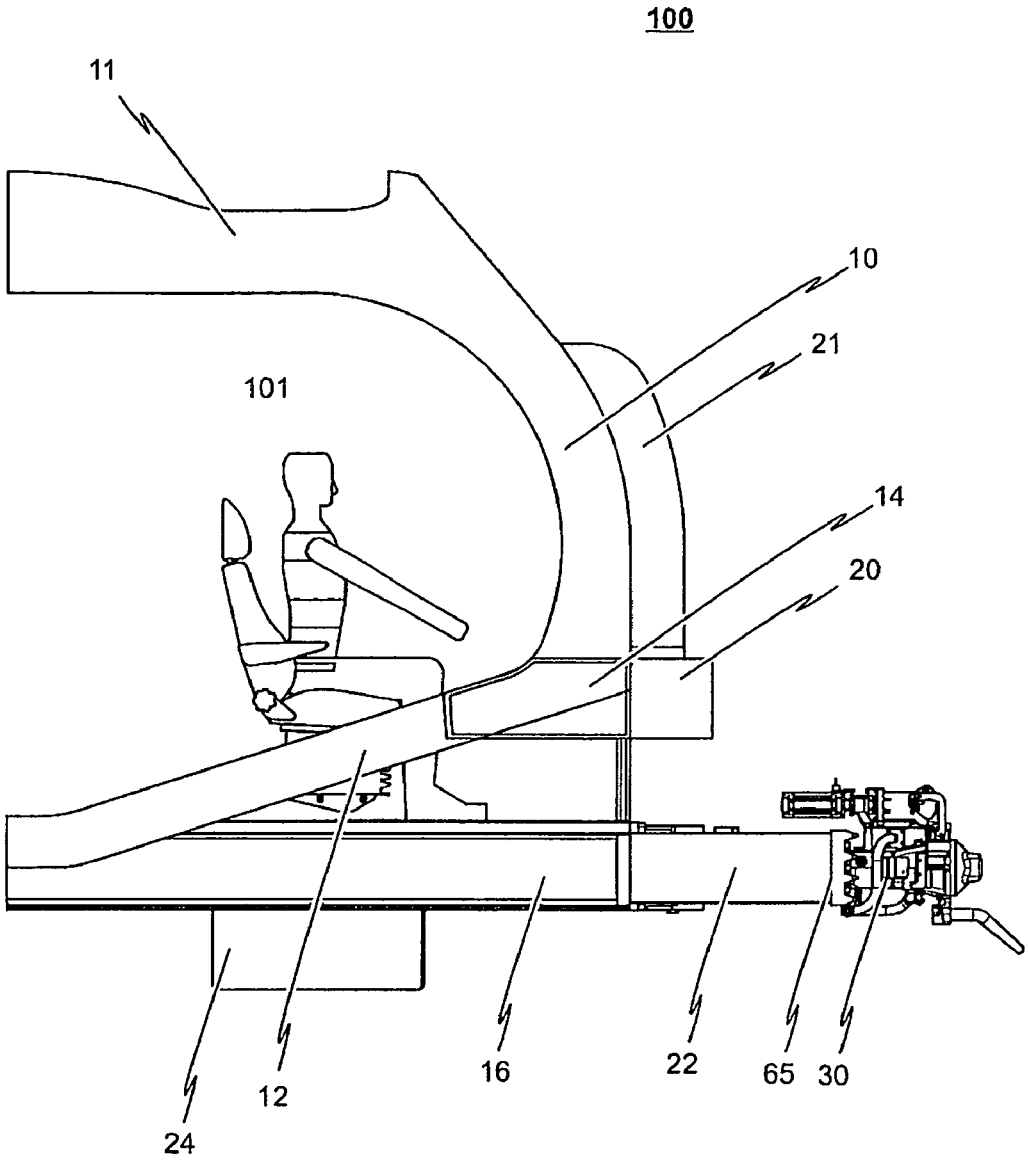
Figure 3:
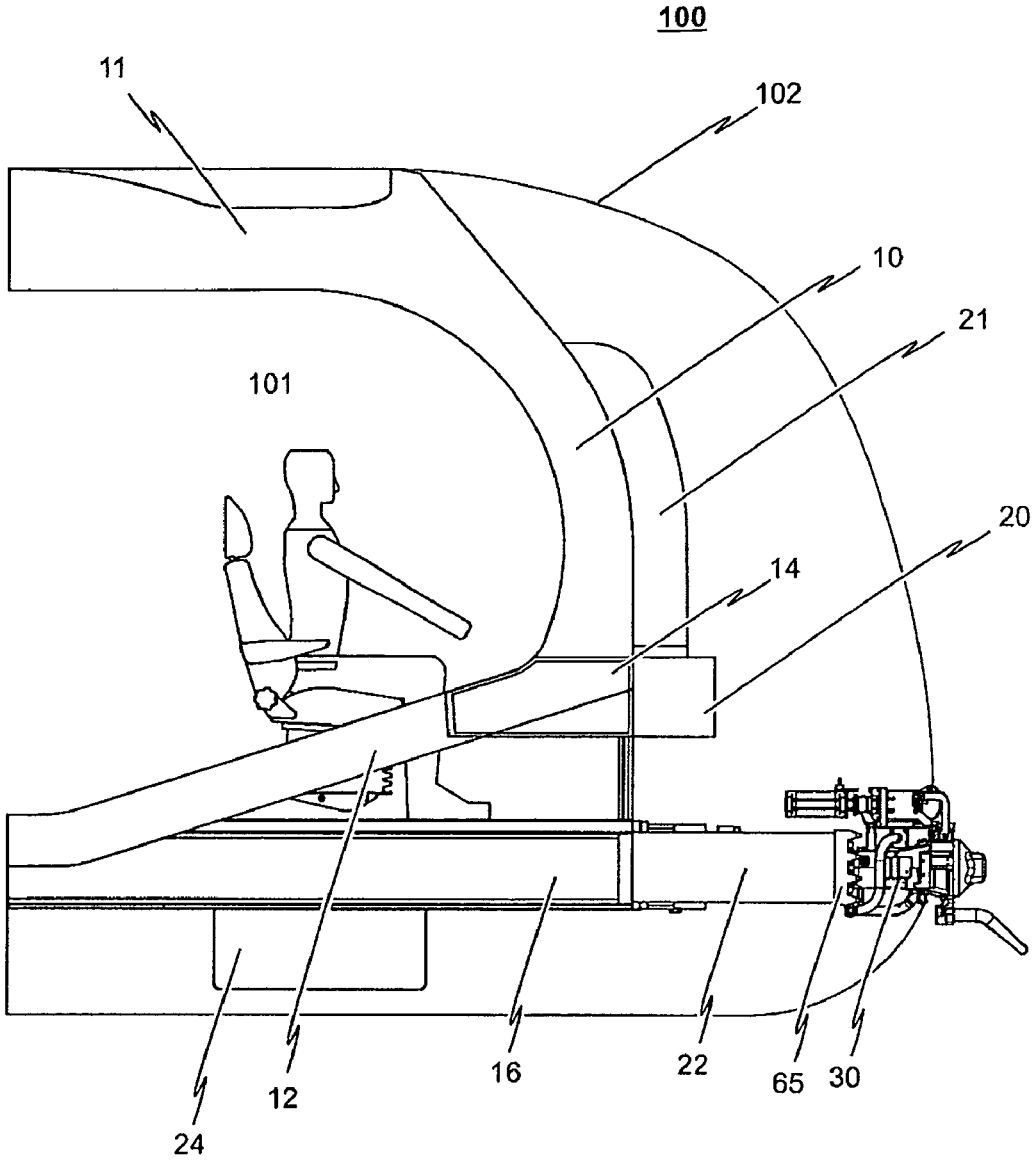
Figure 4:
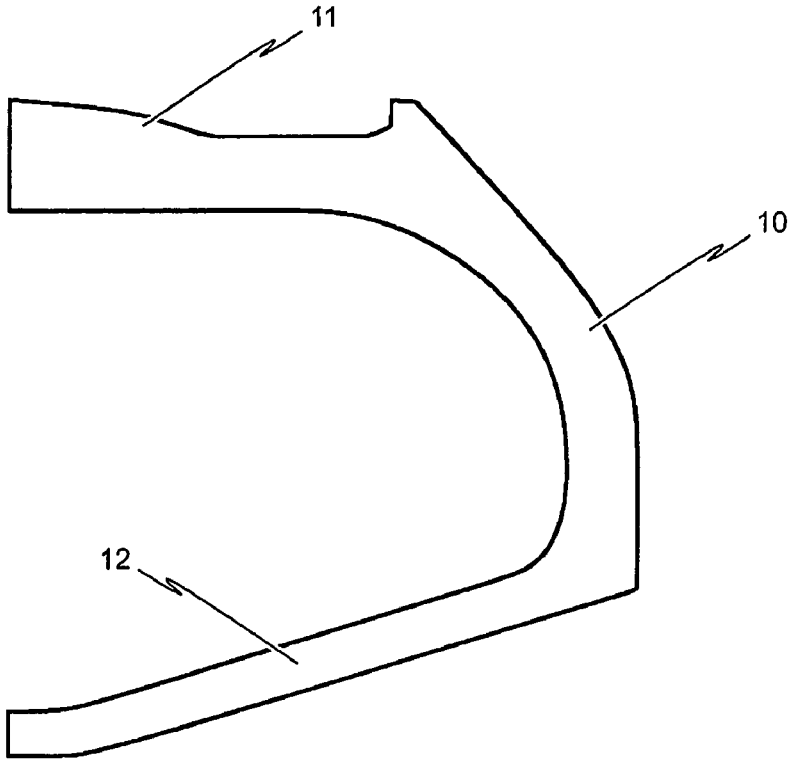
Figure 5:
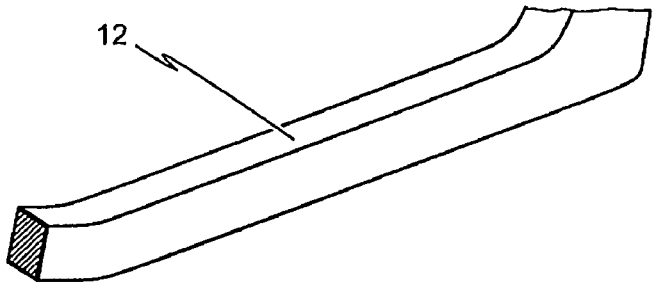
Figure 6:
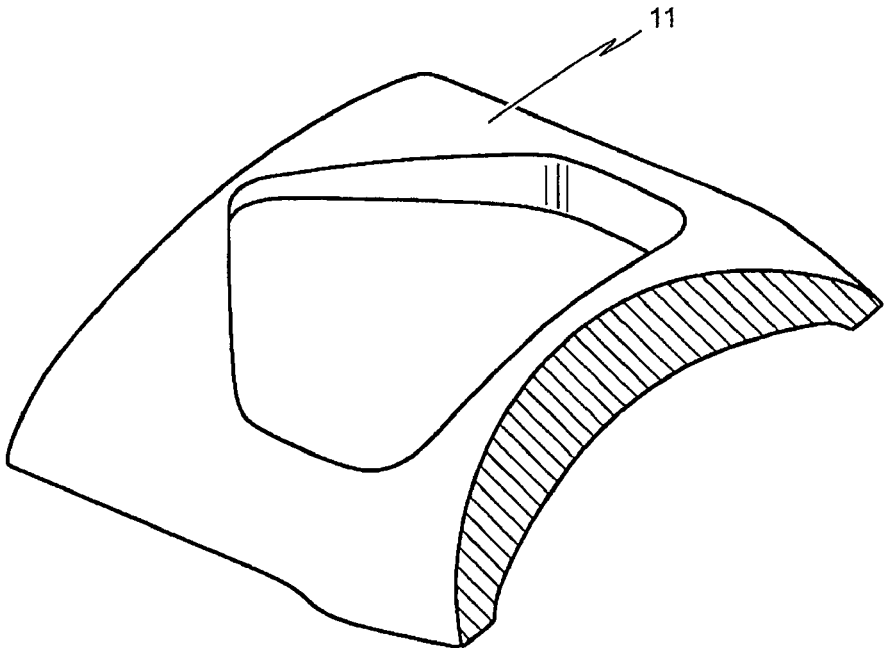
Figure 7:
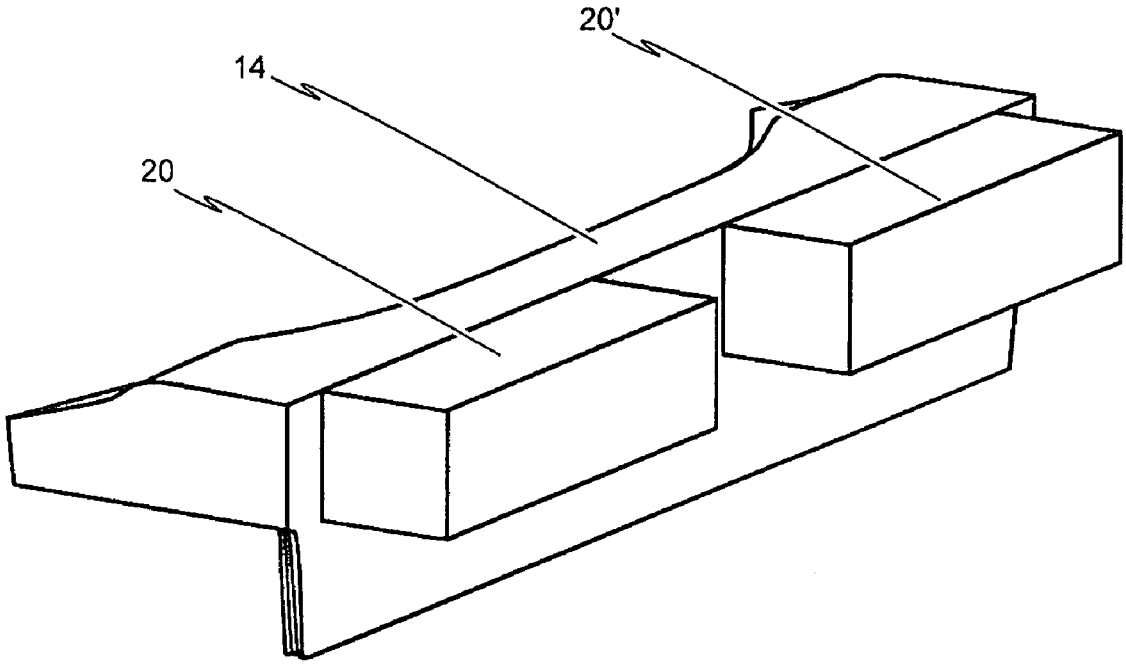
Figure 8:
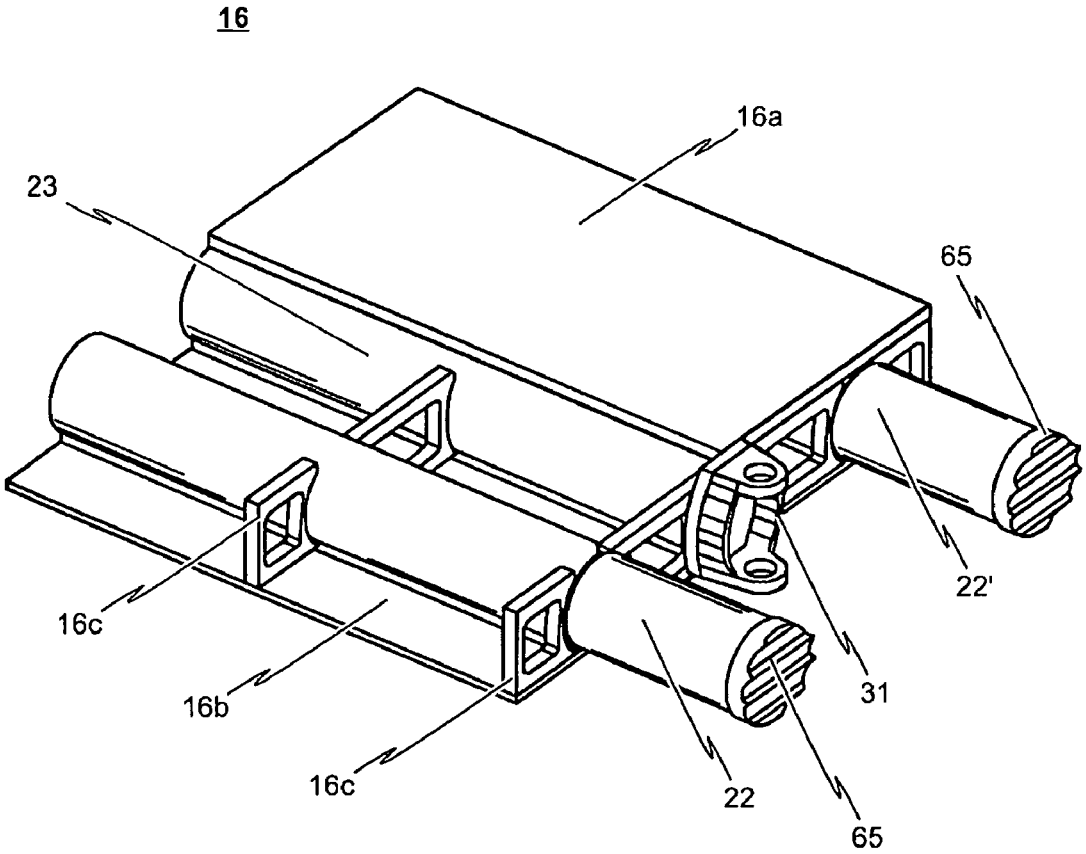
Figure 9:
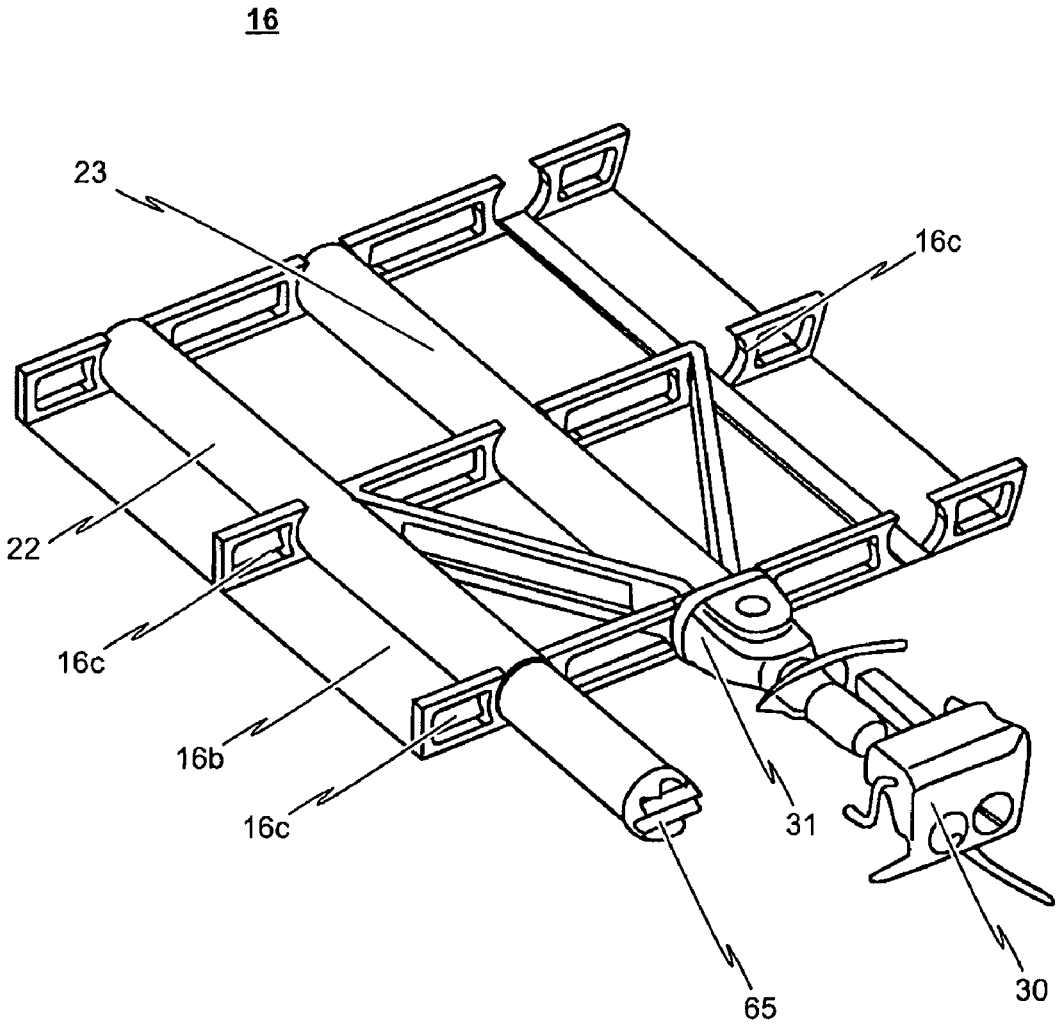
Figure 10:
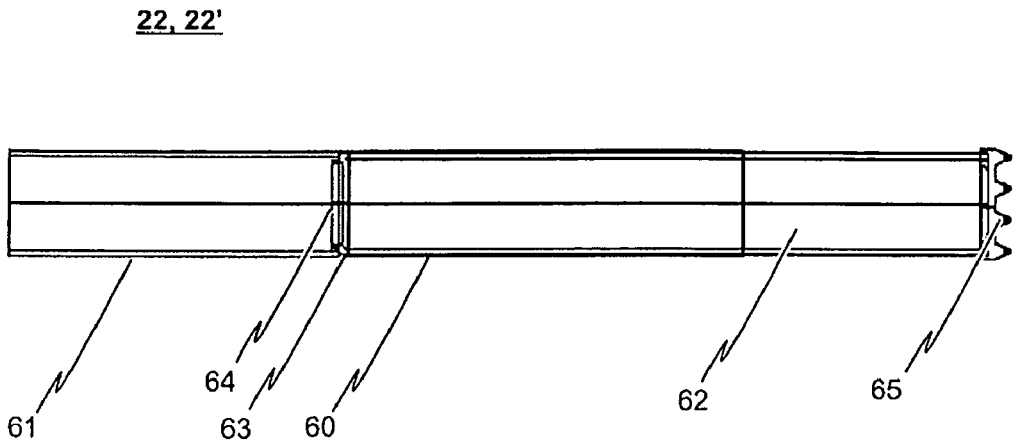
Figure 11:
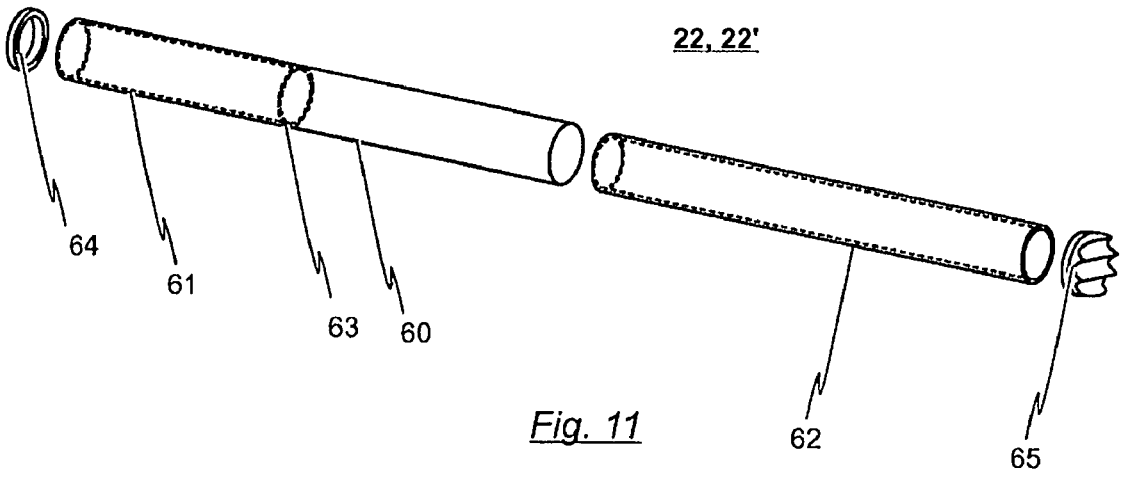
Figure 12:
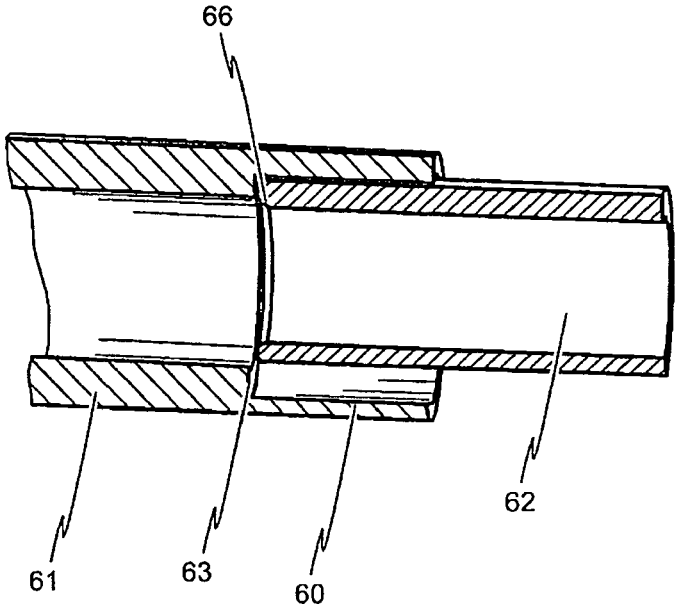
Figure 13:
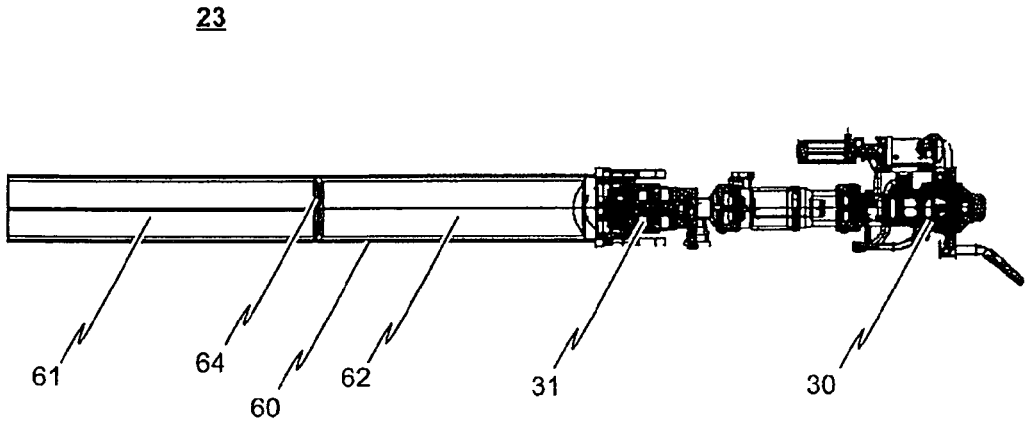
Figure 14:
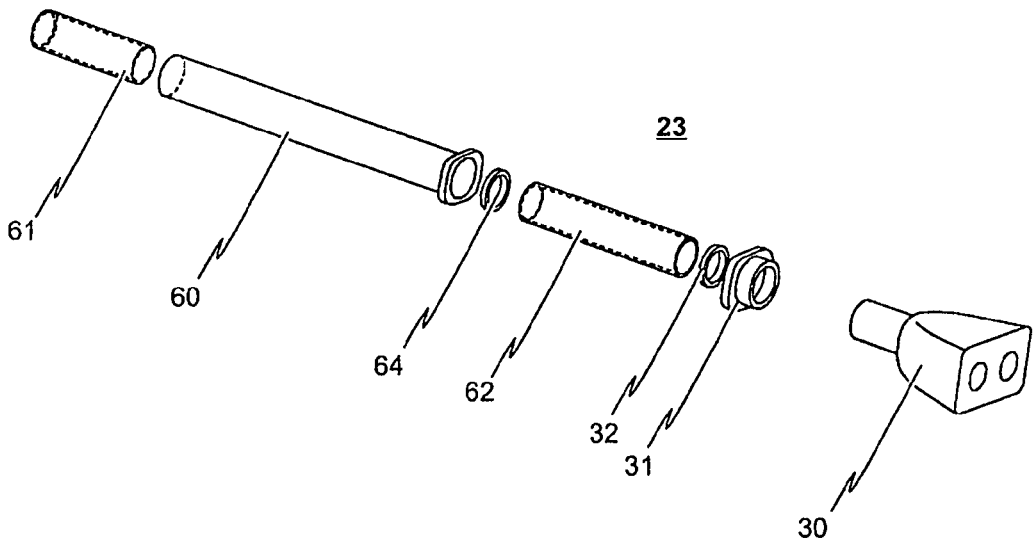
Figure 15:
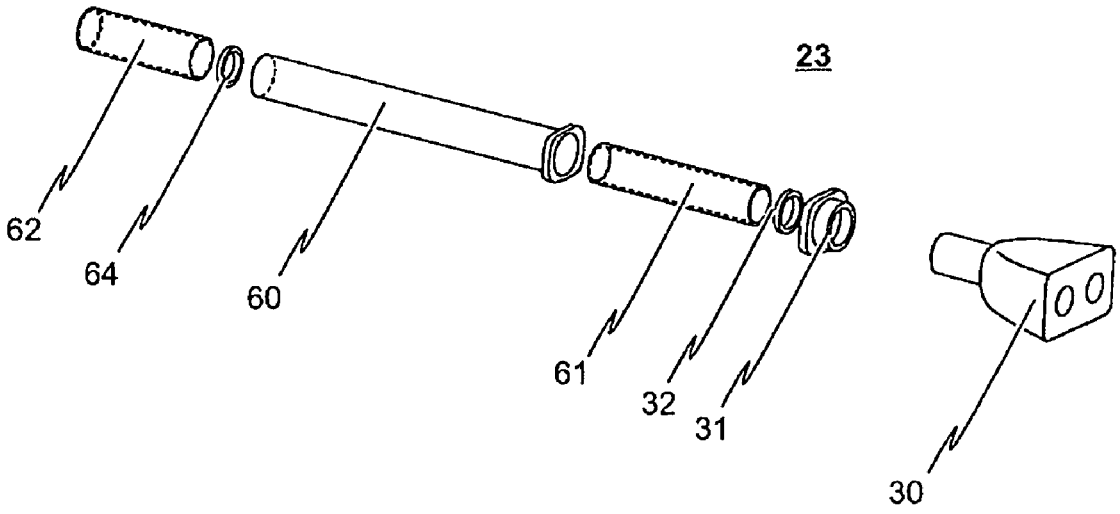
Figure 16:
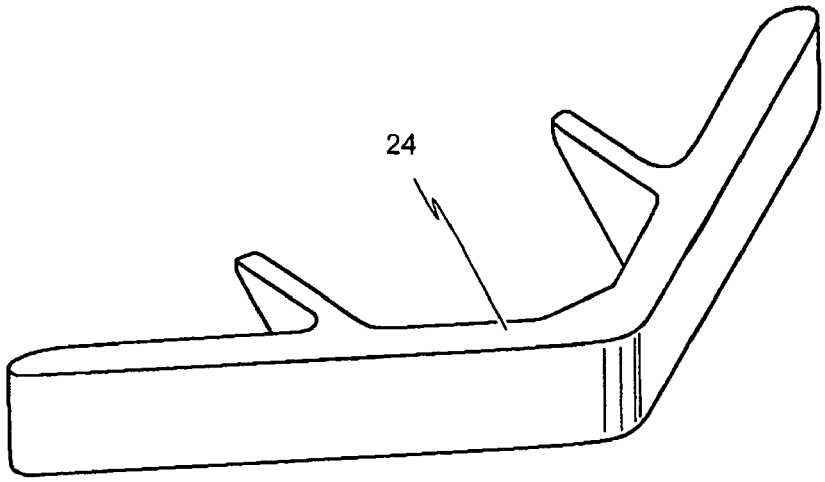
Figure 17:
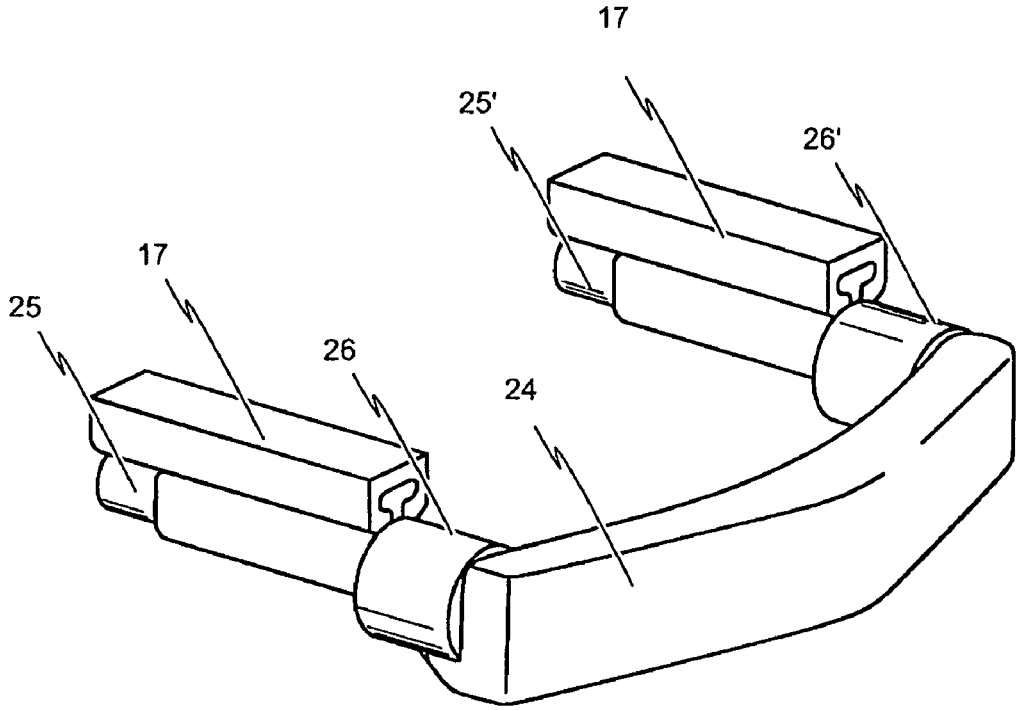
Figure 18:
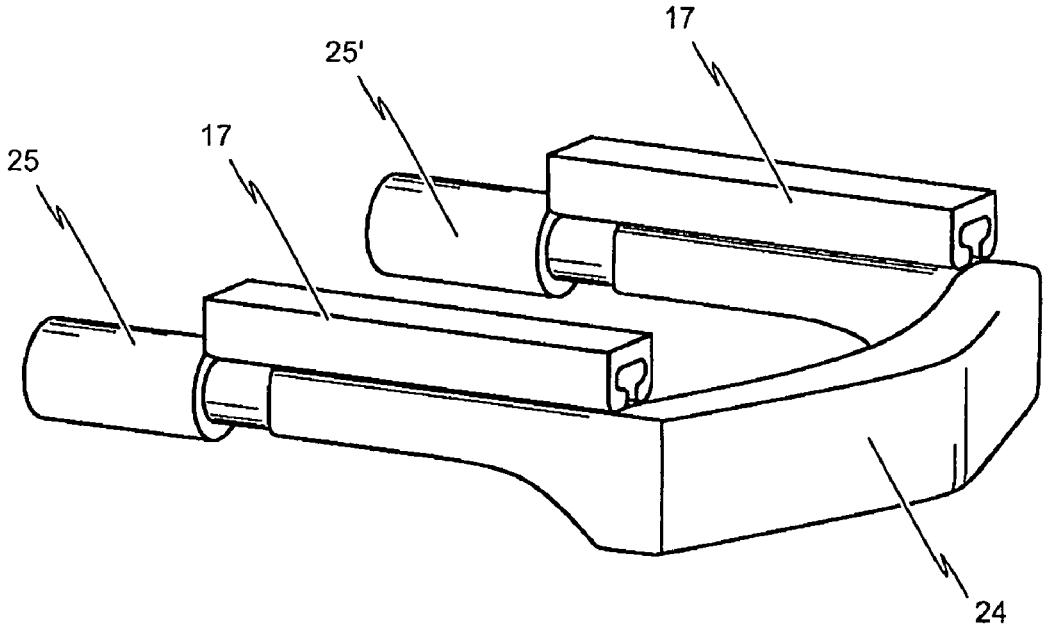

Shown are:

FIG. 1 a perspective view of a first embodiment of the vehicle front-end module structure of the vehicle front-end module according to the invention;

FIG. 2 a side view of the vehicle front-end module structure according to FIG. 1;

FIG. 3 a side view of the vehicle front-end module structure according to the first embodiment having a structure pursuant FIG. 1 and an implied external design;

FIG. 4 a side view of an A pillar with a side strut affixed to a lower section of the A pillar and a roof structure affixed to the upper section of the A pillar;

FIG. 5 a perspective view of the side strut pursuant FIG. 4;

FIG. 6 a perspective view of the roof structure employed in the vehicle front-end module structure pursuant FIG. 1;

FIG. 7 a perspective view of the railing element employed in the vehicle front-end module structure pursuant FIG. 1 with the first energy-absorbing elements affixed thereto;

FIG. 8 a perspective, partly sectional view of the undercarriage structure employed in the vehicle front-end module structure pursuant FIG. 1;

FIG. 9 a perspective view of the components of the undercarriage structure pursuant FIG. 8;

FIG. 10 a cutaway side view of the third energy-absorbing element employed in the under-carriage structure pursuant FIG. 8;

FIG. 11 an exploded view of the third energy-absorbing element depicted in FIG. 10;

FIG. 12 a detail of the third energy-absorbing element pursuant FIG. 10;

FIG. 13 a partly sectional side view of the fourth energy-absorbing element employed in the undercarriage structure pursuant FIG. 8;

FIG. 14 an exploded view of the fourth energy-absorbing element depicted in FIG. 13;

FIG. 15 an alternative embodiment of the fourth energy-absorbing element;

FIG. 16 a perspective view of an embodiment of the underride guard employed in the vehicle front-end module structure pursuant FIG. 8;

FIG. 17 an alternative embodiment of the underride guard;

FIG. 18 an alternative embodiment of the underride guard; and

Figure 19:
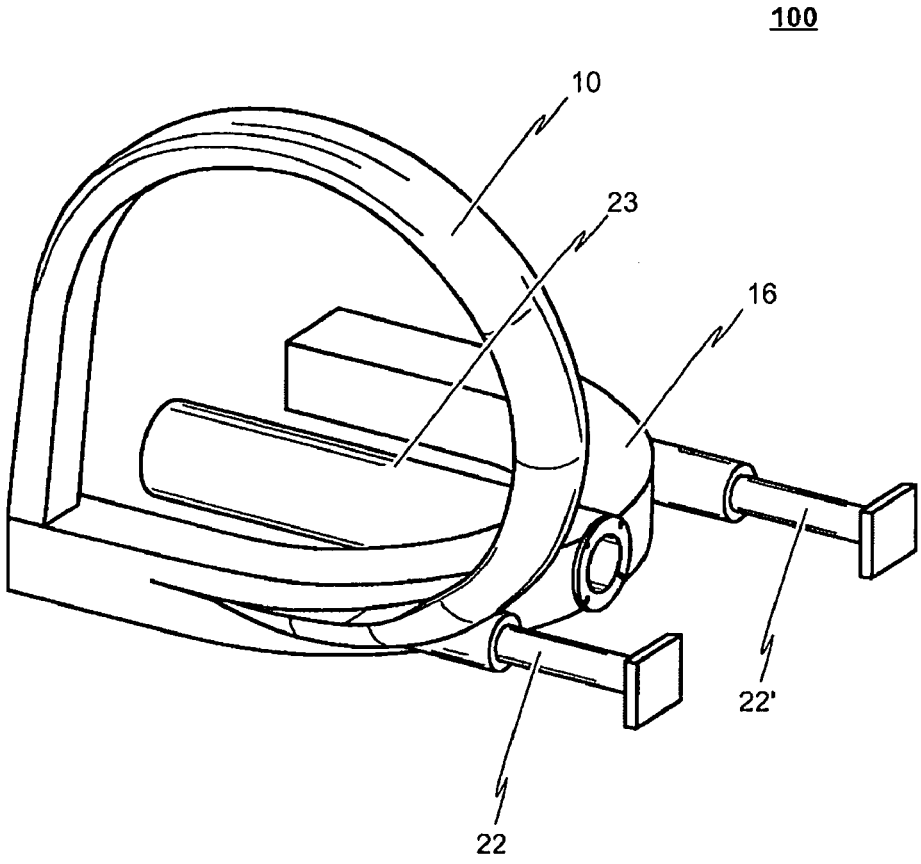

FIG. 19 an alternative embodiment of the inventive vehicle front-end module structure.

The following will reference the drawings in describing a first embodiment of the vehicle front-end module structure 100 which can be utilized with the inventive vehicle front-end module.

In detail, FIG. 1 shows a perspective view of the first embodiment of the vehicle front-end module structure 100. FIG. 2 shows a side view of the vehicle front-end module structure 100 pursuant FIG. 1. FIG. 3 shows a side view of the vehicle front-end module according to the first embodiment with a vehicle front-end module structure 100 pursuant FIG. 1 or 2 and an implied external design 102.

Accordingly, the vehicle front-end module structure 100 shown in the depicted embodiment is designed to be mounted to the front end of a (not explicitly shown) rail vehicle. The vehicle front-end module structure 100 is made completely from structural elements which will be described below, in particular with reference to FIGS. 4-18. These structural elements which make up the vehicle front-end module structure 100 are made wholly from fiber-reinforced plastic and can be realized in differential, integrated or composite constructions. In consideration of the advantages related to the sturdiness and manufacturing of the fiber composite/fiber composite sandwich structures with the objective of simple construction, it is provided to have the rail vehicle front-end module to be of integrated construction the greatest extent possible.

Fiber-reinforced plastic is made from reinforcing fibers embedded in polymer matrix systems. While the matrix holds the fibers in a predetermined position, transfers loads between the fibers and protects the fibers from external influences, the reinforcing fibers are accorded load-bearing mechanical properties. Glass, aramid and carbon fibers are particularly suitable as reinforcing fibers. Because aramid fibers exhibit only a relatively low rigidity due to their ductility, glass and carbon fibers are preferred in the constructing of the respective energy-absorbing elements for the vehicle front-end module structure 100. However, aramid fibers are suited, for example, for constructing the deformation-resistant end wall 15 which serves to protect a vehicle driver's cab 101 accommodated within the self-supporting structure of the vehicle front-end module from intrusions in the event of a crash.

The construction of the respective structural elements of the vehicle front-end module structure 100 is preferably realized in a specific fiber architecture, a specific layer construction respectively, in order to maintain the properties of the structural elements adapted to the expected load condition. Using a carbon fiber-reinforced plastic is particularly preferred as the material for the structural elements forming the deformation-resistant, self-supporting structure of the vehicle front-end module 100 since such a material exhibits very high specific rigidities. By specifying a layer/sandwich construction for the material including the materix system and the manufacturing method, not only are the loads in the direction of impact force absorbed, which largely correspond to the longitudinal direction of the vehicle, but also all the further loads affecting the space during operation and upon crashes; i.e. transverse forces and torque.

As indicated at the outset, the vehicle front-end module structure 100 designed according to the inventive teaching is characterized by being made wholly from structural elements of fiber-reinforced plastic, wherein the structural elements forming the vehicle front-end module structure 100 comprise both structural elements which do not absorb energy ("first structural elements") as well as structural elements which do absorb energy ("second structural elements"). The first structural elements are designed and directly connected together so as to form a substantially deformation-resistant, self-supporting front end structure to accommodate a vehicle driver's cab 101.

In the embodiment of the vehicle front-end module structure 100 depicted in the drawings, two A pillars 10, 10' are in particular arranged as part of the first structural elements at the sides of the vehicle front-end module structure 100, thus forming the substantially deformation-resistant, self-supporting structure of the vehicle front-end module structure 100, as is a roof structure 11 fixedly connected to the respective upper areas of the two A pillars 10, 10'. In the embodiment of the vehicle front-end module structure 100, for example according to FIG. 1, side struts 12, 12' fixedly connected to the respective lower areas of the two A pillars 10, 10' and serving to transmit impact forces to the car body structure of the (not explicitly shown) rail vehicle are further part of the first structural elements.

FIG. 4 depicts a side view of an A pillar 10 connected to a side strut 12 and a roof structure 11, wherein this combination of A pillar 10, side strut 12 and roof structure 11 is used in the embodiment of the vehicle front-end module structure depicted in FIG. 1.

FIG. 5 shows a perspective view of the side strut 12.

Additionally to the first structural elements which form the deformation-resistant, self-supporting vehicle front-end module structure 100, the depicted embodiment of the vehicle front-end module structure 100 further comprises a railing element 14 as well as the previously-cited deformation-resistant end wall 15. The railing element 14 used in the embodiment of the vehicle front-end module structure 100 depicted in FIG. 1 is shown in a separate representation in FIG. 7.

FIG. 6 shows the roof structure 11 used in the embodiment pursuant FIG. 1.

In addition to the first structural elements, the vehicle front-end module structure 100 according to the invention also comprises—as indicated above—second structural elements; i.e. energy-absorbing structural elements. Among these second structural elements are first energy-absorbing elements

20, 20' made of fiber-reinforced plastic. It is hereby provided for at least one energy-absorbing element to be disposed on the front end of the railing element 14 in the depiction of FIG. 1 and exactly two first energy-absorbing elements 20, 20' especially in the depiction of FIG. 7.

These first energy-absorbing elements 20, 20' arranged on the front end of railing element 14 are made of a fiber composite/fiber composite sandwich material and designed to respond upon the exceeding of a critical impact force and absorb at least part of the impact energy which occurs in the transmission of impact force and which is introduced into said first energy-absorbing elements 20, 20' by the non-ductile destruction of at least one part of the fiber structure of said first energy-absorbing elements 20, 20'.

On the other hand, the second structural elements likewise include second energy-absorbing elements 21, 21' made of a fiber composite/fiber composite sandwich material attached to the two A pillars 10, 10' of the supporting structure of the vehicle front-end module 100. In the embodiment of the vehicle front-end module structure depicted in FIG. 1, one second energy-absorbing element 21, 21' each is arranged on each of the surfaces of the A pillars 10, 10' facing the front end of the vehicle front-end module structure 100. As is the case with the first energy-absorbing elements 20, 20', the second energy-absorbing elements 21, 21' are also made of fiber composite/fiber composite sandwich material and designed to respond upon the exceeding of a critical impact force and absorb at least part of the impact energy which occurs during the transmission of impact force and which is introduced into said second energy-absorbing elements 21, 21' by the non-ductile destruction of at least one part of the fiber structure of said second energy-absorbing elements 21, 21'.

The first and the second energy-absorbing elements 20, 20' and 21, 21' are fixedly attached, preferably in a material fit, in particular adhesively bonded, to the corresponding first structural elements; i.e. the railing element 14 and the A pillars 10, 10'.

Together with the side struts 12, 12', the A pillars 10, 10' and the roof structure 11 fixedly connected thereto form a self-supporting, deformation-resistant front-end structure which is designed to be both operationally secure as well as crashworthy and controllably dissipate that part of the impact energy introduced into the vehicle front-end module structure 100 upon a crash which was not already absorbed by the second structural elements through the deformation-resistant vehicle front-end module structure 100 in order to limit the accelerations and forces acting on the driver's cab and the car body structure of the rail vehicle attached to the vehicle front-end module.

In one preferred realization of the inventive solution, the side struts 12, 12' and the A pillars 10, 10' are comprised of a fiber-reinforced plastic hollow profile in which a supporting material, for example foam, is filled to increase the rigidity of the side struts 12, 12', the A pillars 10, 10' respectively. On the other hand, it is advisable to produce the roof structure 11 in a sandwich structure of fiber-reinforced plastic material.

The railing element 14 primarily serves to structurally connect the two A pillars 10, 10' such that said railing element 14 connects the respective lower areas of the two A pillars 10, 10' together. The above-identified deformation-resistant end wall 15 is connected to the railing element 14 so as to form an end face of the vehicle front-end module structure 100 in order to protect the vehicle driver's cab 101 accommodated in the self-supporting structure from intrusions upon a crash.

The following will make reference to FIGS. 8 and 9 in describing the undercarriage structure 16 as provided in the vehicle front-end module structure 100 pursuant FIG. 1.

In detail, the undercarriage structure 16 is made of a fiber composite/fiber composite sandwich material and connected to the first structural elements of the vehicle front-end module structure 100 so as to form the floor of the driver's cab 101, the base of the vehicle front-end module structure 100 respectively.

As can particularly be noted from the representation depicted in FIG. 8, the undercarriage structure 16 comprises an upper surface element 16*a* made of a fiber composite/fiber composite sandwich material and a lower surface element 16*b* likewise made of fiber composite/fiber composite sandwich material spaced at a distance therefrom, wherein said surface elements 16*a*, 16*b* are spaced at a distance from one another. Fiber-reinforced plastic struts 16*c* are further provided to fixedly connect the upper and lower surface elements 16*a*, 16*b* to one another.

Two third energy-absorbing elements 22, 22' are accommodated in the undercarriage structure 16 in the depicted embodiment of the inventive vehicle front-end module structure 100, whereby each of these third energy-absorbing elements 22, 22' constitutes a crash buffer.

On the other hand, the embodiment of the vehicle front-end module structure 100 pursuant FIG. 1 comprises a crash-coupling having integrated energy-absorbing elements which essentially consists of a fourth energy-absorbing element 23, a bearing block 31, as well as a central buffer coupling 30. As FIG. 9 shows, the fourth energy-absorbing element 23 is arranged in the under-carriage structure 16 behind the bearing block 31 in the direction of impact and serves to irreversibly absorb at least part of the impact energy introduced into the undercarriage structure 16 via the central buffer coupling 30.

The following will make reference to the depictions provided in FIGS. 10 through 12 in describing the construction and the functioning of the embodiment of the third energy-absorbing elements (crash buffers) employed in the depicted embodiment in greater detail.

It can be discerned from FIGS. 10 and 11 that the third energy-absorbing element 22, 22' essentially consists of a guide tube 60 and a pressure tube 62. Specifically, the pressure tube 62 is configured as a plunger and at least the section of the guide tube 60 facing the pressure tube 62 is configured as a cylinder. The section of the plunger-configured pressure tube 60 facing the guide tube 62 is telescopically received in the section of the guide tube 60 configured as a cylinder.

The guide tube 60 is formed in one-piece configuration from fiber-reinforced plastic. Specifically, the guide tube 60 comprises an energy-absorbing section 61 as well as a guide section adjoining the energy-absorbing section.

As can especially be noted from the FIG. 12 representation, a bevel is provided at the transition between the energy-absorbing section 61 and the guide section which forms a stop 63 against which the plunger-configured pressure tube 62 strikes. In detail, the guide tube 60 is thus designed as a fiber-reinforced plastic tubular body comprising a projection in its interior which forms the stop 63. On the other hand, the plunger-configured pressure tube 62 is designed as a tubular body comprising an inner chamfer 66 (cf. FIG. 12).

Of course, it is just as conceivable to design the guide tube 60 and the pressure tube 62 shown as an example here so as to have an annular cross-section with a different cross-sectional geometry, for example an oval, rectangular, square, triangular or pentagonal cross-sectional geometry.

As can be noted from the FIG. 12 representation, it is in principle conceivable for the front end of the section of the pressure tube 62 configured as a plunger facing the guide tube 60 to directly strike against the stop 63 of the energy-absorbing section 61. However, also conceivable hereto is the providing of a conical ring 64 on the front end of the plunger-configured pressure tube 62 so that said conical ring 64 strikes the stop 63 of the guide tube 60 (cf. FIGS. 10 and 11). The conical ring 64 is to thereby be fixedly connected to the front end of the pressure tube 62.

The guide section of the guide tube 60 is designed as a guide tube in the embodiment depicted in FIGS. 10 and 11, its inner diameter larger than the outer diameter of the pressure tube 62 configured as a plunger. Doing so allows the section of the pressure tube 62 facing the guide tube 60 to be telescopically accommodated in the guide tube 60.

As can be especially noted from the FIG. 10 representation, the overall tubular guide tube 60 exhibits an inner diameter within the energy-absorbing section 61 which is smaller than the outer diameter of the pressure tube 62 (cf. also the FIG. 12 representation hereto). The bevel 63 provided at the transition between the guide section and the energy-absorbing section 61 thus constitutes a stop against which the pressure tube 62 configured as a plunger strikes. The structural design of this transition section as a trigger area for the pressure tube 62 decisively influences the initial force peaks and the force-deformation behavior of the fiber composite energy-absorbing element (pressure tube 62).

The third energy-absorbing element 22, 22' exemplarily depicted in FIGS. 10 and 11 is on the other hand designed such that the impact forces introduced into said energy-absorbing element 22, 22' and especially into the pressure tube 62 configured as a plunger are directed to the front end of the pressure tube 62 facing away from the guide tube 60. To this end, it is conceivable to mount a climbing guard 65 to the front end of the pressure tube 62 facing away from the guide tube 60.

The critical impact force for the activation of the third energy-absorbing element 22, 22' is determined by the material properties and structural design, particularly in the transition area (trigger area, stop 63). Specifically, the critical impact force for the activation of the third energy-absorbing element 22, 22' is determined by the material properties and structural design of the energy-absorbing section 61. Upon the activation of the third energy-absorbing element 22, 22', the fiber composite material of the inner wall of energy-absorbing section 61 is non-ductilely frayed by the pressure tube 62 moving in the direction of the energy-absorbing section 61 relative to the guide tube 60.

Essential in the process is that the pressure tube 62 moving in the direction of energy-absorbing section 61 only effects a non-ductile fraying of that material of energy-absorbing section 61 forming the inner wall of said energy-absorbing section 61. During the absorbing of energy, the pressure tube 62 thus pushes further into the guide tube 60, thereby abrading the inner area of energy-absorbing section 61. This abrading causes the fraying of the material of energy-absorbing section 61, whereby the outer wall of energy-absorbing section 61 remains unaffected. The outer wall of energy-absorbing section 61 which is then left serves as a guide surface for guiding the movement of the pressure tube 62 relative the guide tube 60.

So that only the fiber composite material of energy-absorbing section 61, and not for example the material of the pressure tube 62, will be frayed upon the activation of the third energy-absorbing element 22, 22', the front end of the pressure tube 62 is to have a higher rigidity than said energy-absorbing section 61.

As can be especially noted from the FIG. 12 representation, the pressure tube 62 realized as a plunger is configured as an open hollow body at its front end facing the guide tube 60, wherein this hollow body comprises an inner chamfer 66. The fractions of the fiber-reinforced plastic energy-absorbing section 61 which develop upon the movement of the pressure tube 62 relative the guide tube 60 are thereby accommodated inside the hollow body. This has the advantage that no fractions of the fiber-reinforced plastic material can exit to the outside upon the fraying of energy-absorbing section 61.

The following will make reference to the depictions provided in FIGS. 13-15 in describing possible embodiments of the fourth energy-absorbing element 23, as provided in the undercarriage structure 16 of the vehicle front-end module structure 100.

Specifically, the fourth energy-absorbing element 23 serves in the absorbing of impact forces introduced into the undercarriage structure 16 via the central buffer coupling 30 upon a crash. To this end, the fourth energy-absorbing element 23 is arranged behind the bearing block 31 in the direction of impact in a horizontal and vertical swivel mounting by means of the central buffer coupling 30.

The fourth energy-absorbing element 23 comprises a guide tube 60 preferably made of fiber-reinforced plastic, a crash tube 61, as well as a pressure tube 62. In detail, in the embodiment depicted in FIG. 13, the crash tube 61 is telescopically accommodated in the section of the guide tube 60 facing the central buffer coupling 30 and the pressure tube 62 is telescopically accommodated in the oppositely-positioned section. A tapering 64 is arranged between the crash tube 61 and the pressure tube 62, for example in the form of a conical ring. In the event of a crash, the connecting elements of coupling 30 break away from the bearing block 31. The coupling guided into guide tube 60 presses against a baffle plate 32. The baffle plate 32 directs the impact force into the pressure tube 62 which moves in the direction of the crash tube 61 relative the guide tube 60. In so doing, the pressure tube 62 presses against the crash tube 61 via the tapering 64. Upon reaching the defined deformation force, the tapering 64 and the pressure tube 62 are forced through the crash tube 61 which then non-ductilely frays, thereby absorbing at least part of the impact energy occurring in the transmission of impact force. The deformed or frayed material of crash tube 61 thereby remains inside pressure tube 62.

As is the case with the third energy-absorbing element 22, 22' described above with reference to the FIGS. 10 and 11 representations, it is preferred for all the components of the fourth energy-absorbing element 23 to be made of fiber-reinforced plastic. If necessary, however, the tapering 64 can be a metal structure.

FIG. 15 depicts an alternative embodiment of the fourth energy-absorbing element 23. As is the case with the energy-absorbing element 23 pursuant FIGS. 13 and 14, the embodiment depicted in FIG. 15 also consists of a support or pressure tube 62, a tapering 64, a guide tube 60 and a crash tube 61, whereby in this case, however, the crash tube 61 is provided in the section of the guide tube 60 facing the central buffer coupling 30. Upon a crash, the coupling 30 breaks away from the bearing block 31 and presses against the baffle plate 32, wherein the baffle plate 32 introduces the impact force into the crash tube 61 so that the crash tube 61 is pressed into the tapering 64. Upon reaching the deformation force level, the crash tube 61 pushes through the tapering 64 into the pressure tube 62, which can simultaneously be a part of the guide tube 60 (cf. FIG. 12). The absorption of the energy again occurs through the tapering of the crash tube 60. The deformed or frayed material of the crash tube 61 remains inside pressure tube 62.

FIG. 16 shows a perspective view of an underride guard 24 made from a fiber composite/fiber composite sandwich material which is affixed to the underside of the undercarriage structure 16 in the vehicle front-end module structure 100 depicted in FIG. 1 and which is designed to absorb by controlled deformation at least part of the impact energy occurring during the transmission of impact force and introduced into said underride guard 24 upon the exceeding of a critical impact force.

FIGS. 17 and 18 depict alternative embodiments of the underride guard 24.

Specifically, the underride guard 24 in these embodiments is in each case connected to the undercarriage structure 16 by means of a rail system 17. In the embodiment depicted in FIG. 17, the underride guard 24 is made from a fiber composite/fiber composite sandwich material and comprises a plurality of energy-absorbing elements 25, 25', 26, 26' (two in the front area and two in the rear area). The energy-absorbing elements 25, 25' first absorb collision energy in the front area at varying deformation force levels, then the underride guard 24 is pushed within the rails 17 to the second energy-absorbing elements 26, 26'.

In the embodiment of the underride guard 24 depicted in FIG. 18, the underride guard 24 is pushed along the guide rail 17 to crash elements 25, 25' upon a crash.

FIG. 19 shows parts of a further embodiment of the vehicle front-end module structure 100 in a perspective view. Particularly characteristic of this embodiment is the A pillars 10, whereby FIG. 19 only depicts one of the two A pillars for the sake of clarity. The A pillars 10 in the embodiment depicted in FIG. 19 exhibit an overall curved structure such that the forces introduced into the A pillars 10 can be transmitted directly to the undercarriage 16 without any additional side struts. This special variant allows considerable reversible compression of the A pillars 10 during a crash. The crash buffers 22, 22' are integrated into the horseshoe-shaped undercarriage 16, wherein the coupling connection is effected by means of an integrated support tube 23.

The invention is not limited to the embodiments depicted as examples in the figures but instead ensues from a comprehensive review of all the features as disclosed herein.

LIST OF REFERENCE NUMERALS

10, 10' A pillars
11 roof structure (roof B3)
12, 12' side struts (side struts B1)
14 railing element (railing B4)
15 end wall (end wall B5)
16 undercarriage structure (lower structure B6)
16*a* upper surface element of the undercarriage structure
16*b* lower surface element of the undercarriage structure
16*c* undercarriage structure struts
17 guide rail of the underride guard/rail guard
20, 20' first energy-absorbing element (energy-absorbing element B10)
21, 21' second energy-absorbing element (energy-absorbing element B9)
22, 22' third energy-absorbing element (crash buffer B7)
23 fourth energy-absorbing element (crash-coupling B8)
24 rail guard (rail guard B11)
25, 25' fifth energy-absorbing element (part of the rail guard)
26, 26' sixth energy-absorbing element (part of the rail guard)
30 central buffer coupling
31 bearing block
32 baffle plate
60 guide tube
61 energy-absorbing section/crash tube
62 support tube
63 bevel/stop
64 tapering/conical ring
65 climbing guard
66 inner chamfer
100 vehicle front-end module/vehicle front-end module structure
101 vehicle driver's cab
102 external cladding

The invention claimed is:

1. A vehicle front-end module having a vehicle front-end structure for mounting to the front end of a rail-borne vehicle, in particular a railway vehicle, wherein the vehicle front-end structure is wholly composed of structural elements made from fiber composite or fiber composite sandwich material, wherein the structural elements forming the vehicle front-end structure comprise first structural elements which are configured and directly connected to one another so as to form a substantially deformation-resistant, self-supporting front-end structure designed to accommodate a vehicle driver's cab, and wherein the structural elements forming the vehicle front-end structure comprise second structural elements connected to the first structural elements and designed such that at least a portion of an impact energy occurring due to a transmitting of impact force and introduced into the structure upon a collision of the rail-borne vehicle is dissipated by at least partly irreversible deformation or at least partial destruction of the second structural elements, wherein to form the substantially deformation-resistant, self-supporting frame structure, the first structural elements comprise A pillars arranged on each side of the front-end module structure as well as a roof structure fixedly connected thereto at respective upper areas of the two A pillars, wherein the A pillars and the roof structure fixedly connected thereto are designed to transmit a portion of an impact energy introduced into the vehicle front-end module not already absorbed by the second structural elements to a car body structure of the rail vehicle connected to the vehicle front-end module upon a crash, and wherein the side struts and/or the A pillars are comprised of a fiber-reinforced plastic hollow profile in which a supporting material is accommodated in order to increase the rigidity of the side struts and the A pillars respectively.

2. The vehicle front-end module according to claim 1, wherein the first structural elements further comprise side struts fixedly connected to the respective lower areas of the two A pillars and serving to transmit a portion of an impact energy not already absorbed by the second structural elements to the car body structure of the rail vehicle upon a crash.

3. The vehicle front-end module according to claim 1, wherein the A pillars are respectively of curved design and wherein the first structural elements further comprise an undercarriage structure fixedly connected to the lower end regions of the A pillars and designed to transmit a portion of an impact energy introduced into the A pillars not already absorbed by the second structural elements to the car body structure of the rail vehicle upon a crash.

4. The vehicle front-end module according to claim 1, wherein the roof structure is manufactured in a sandwich construction from a fiber-reinforced plastic.

5. The vehicle front-end module according to claim 1, wherein the first structural elements comprise a railing element which connects the respective lower areas of the two A pillars together to effect the structural connection of said two A pillars.

6. The vehicle front-end module according to claim 1, wherein the first structural elements comprise a railing element which connects the respective lower areas of the two A pillars together to effect the structural connection of said two A pillars, and wherein the first structural elements further comprise a deformation-resistant end wall which is connected to the railing element so as to form an end face of the frame in order to protect the vehicle driver's cab accommodated in the self-supporting frame structure from intrusions upon a crash.

7. The vehicle front-end module according to claim 1, wherein the first structural elements comprise a railing element which connects the respective lower areas of the two A pillars together to effect the structural connection of said two A pillars, wherein the first structural elements further comprise a deformation-resistant end wall which is connected to the railing element so as to form an end face of the frame in order to protect the vehicle driver's cab accommodated in the self-supporting frame structure from intrusions upon a crash, and wherein the end wall is made from different fiber composite components, in particular glass-fiber reinforced, aramid, Dyneema and/or carbon fiber-enhanced components.

8. The vehicle front-end module according to claim 1, wherein the first structural elements comprise a railing element which connects the respective lower areas of the two A pillars together to effect the structural connection of said two A pillars, and wherein the second structural elements comprise at least one first energy-absorbing element made from fiber composite/fiber composite sandwich material, wherein said at least one first energy-absorbing element is designed to respond upon an exceeding of a critical impact force and absorb at least a portion of an impact energy occurring during a transmitting of impact force and introduced into said first energy-absorbing element by the non-ductile destruction of at least a part of the fiber structure of said first energy-absorbing element, and wherein the at least one first energy-absorbing element is arranged on the front end of the railing element.

9. The vehicle front-end module according to claim 1, wherein the second structural elements comprise at least one second energy-absorbing element made from fiber-reinforced plastic, wherein said at least one second energy-absorbing element is designed to respond upon an exceeding of a critical impact force and absorb at least a portion of an impact energy occurring during a transmitting of impact force and introduced into said second energy-absorbing element by the non-ductile destruction of at least a part of the fiber structure of said second energy-absorbing element, and wherein at least one second energy-absorbing element is respectively arranged on each of the surfaces of the A pillars facing the front end of the vehicle front-end module.

10. The vehicle front-end module according to claim 1, wherein the second structural elements comprise at least one second energy-absorbing element made from fiber-reinforced plastic, wherein said at least one second energy-absorbing element is designed to respond upon an exceeding of a critical impact force and absorb at least a portion of an impact energy occurring during a transmitting of impact force and introduced into said second energy-absorbing element by the non-ductile destruction of at least a part of the fiber structure of said second energy-absorbing element, and wherein at least one second energy-absorbing element is respectively arranged on each of the surfaces of the A pillars facing the front end of the vehicle front-end module, and wherein the energy-absorbing elements are fixedly connected to the first structural elements in a material fit.

11. A vehicle front-end module having a vehicle front-end structure for mounting to the front end of a rail-borne vehicle, in particular a railway vehicle, wherein the vehicle front-end structure is wholly composed of structural elements made from fiber composite or fiber composite sandwich material, wherein the structural elements forming the vehicle front-end structure comprise first structural elements which are configured and directly connected to one another so as to form a substantially deformation-resistant, self-supporting front-end structure designed to accommodate a vehicle driver's cab, and wherein the structural elements forming the vehicle front-end structure comprise second structural elements connected to the first structural elements and designed such that at least a portion of an impact energy occurring due to a transmitting of impact force and introduced into the structure upon a collision of the rail-borne vehicle is dissipated by at least partly irreversible deformation or at least partial destruction of the second structural elements, wherein an undercarriage structure made from a fiber composite/fiber composite sandwich material is further provided which is connected to at least one part of the first structural elements so as to form the base of the vehicle driver's cab, wherein the second structural elements comprise at least one third energy-absorbing element accommodated in the undercarriage structure and designed to respond upon a predefinable critical impact force being exceeded and absorb at least a portion of an impact energy occurring during a transmitting of impact force and introduced into the third energy-absorbing element by the non-ductile destruction of at least a part of the fiber structure of said third energy-absorbing element, and wherein at least one of the third or a fourth energy-absorbing element comprises a guide tube made of fiber-reinforced plastic and a pressure tube configured as a plunger or a ram, wherein the pressure tube interacts with the guide tube such that upon an exceeding of a critical impact force introduced into the energy-absorbing element, the pressure tube and the guide tube are moved toward one another while simultaneously absorbing at least a portion of an impact energy introduced into said energy-absorbing element, and wherein the guide tube comprises at least one energy-absorbing section made of fiber-reinforced plastic which at least partly frays in a non-ductile manner upon the movement of the pressure tube relative the guide tube.

12. The vehicle front-end module according to claim 11, wherein the undercarriage structure comprises an upper surface element made of fiber-reinforced plastic and a lower surface element made of fiber-reinforced plastic spaced at a distance therefrom as well as struts made of fiber-reinforced plastic which fixedly connect the upper and the lower surface element together.

13. The vehicle front-end module according to claim 11, wherein a central buffer coupling is further provided which is articulated to the undercarriage structure via a bearing block, and wherein the second structural elements comprise at least one fourth energy-absorbing element arranged in the direction of impact in the undercarriage structure behind the bearing block and designed to respond upon an exceeding of a critical impact force and absorb at least a portion of an impact energy occurring during a transmitting of impact forces and introduced into said fourth energy-absorbing element by the non-ductile destruction of at least part of the fiber structure of said fourth energy-absorbing element.

14. The vehicle front-end module according to claim 11, wherein the pressure tube is designed as a hollow body open at its front end facing the guide tube such that the fractions of the fiber-reinforced plastic energy-absorbing section developing upon the movement of the pressure tube relative the guide tube can be at least partly accommodated inside the pressure tube.

15. The vehicle front-end module according to claim 11, wherein the non-ductile frayed length of the energy-absorbing section upon the movement of the pressure tube relative the guide tube is contingent on the distance ensuing from the relative movement between the pressure tube and the guide tube.

16. The vehicle front-end module according to claim 11, wherein the section of the pressure tube configured as a plunger or a ram facing the guide tube is telescopically received by the guide tube such that the section of the pressure tube facing the front end of the guide tube strikes against a stop of the energy-absorbing section.

17. The vehicle front-end module according to claim 11, wherein the section of the pressure tube configured as a plunger or a ram facing the guide tube is telescopically received by the guide tube such that the section of the pressure tube facing the front end of the guide tube strikes against a stop of the energy-absorbing section, and wherein at least the front end of the pressure tube exhibits a higher rigidity than the energy-absorbing section.

18. The vehicle front-end module according to claim 11, wherein the section of the pressure tube configured as a plunger or a ram facing the guide tube is telescopically received by the guide tube such that the section of the pressure tube facing the front end of the guide tube strikes against a stop of the energy-absorbing section, and wherein a conical ring is provided on the front end of the pressure tube which strikes against the stop of the energy-absorbing section.

19. The vehicle front-end module according to claim 11, wherein the section of the pressure tube configured as a plunger or a ram facing the guide tube is telescopically received by the guide tube such that the section of the pressure tube facing the front end of the guide tube strikes against a stop of the energy-absorbing section, and wherein the guide tube exhibits an inner diameter which is larger than the outer diameter of the pressure tube so that the section of the pressure tube facing the guide tube can be received telescopically by said guide tube.

20. The vehicle front-end module according to claim 11, wherein the section of the pressure tube configured as a plunger or a ram facing the guide tube is telescopically received by the guide tube such that the section of the pressure tube facing the front end of the guide tube strikes against a stop of the energy-absorbing section, wherein the guide tube exhibits an inner diameter which is larger than the outer diameter of the pressure tube so that the section of the pressure tube facing the guide tube can be received telescopically by said guide tube, and wherein the guide tube and the energy-absorbing section are integrally formed from fiber-reinforced plastic.

21. The vehicle front-end module according to claim 11, wherein the section of the pressure tube configured as a plunger or a ram facing the guide tube is telescopically received by the guide tube such that the section of the pressure tube facing the front end of the guide tube strikes against a stop of the energy-absorbing section, wherein the guide tube exhibits an inner diameter which is larger than the outer diameter of the pressure tube so that the section of the pressure tube facing the guide tube can be received telescopically by said guide tube, and wherein the energy-absorbing section made from fiber-reinforced plastic is arranged in the interior of the guide tube such that the front end of the pressure tube strikes against a front end of the energy-absorbing section facing away from said pressure tube.

22. The vehicle front-end module according to claim 11, wherein at least one guide surface is provided to guide the movement of the pressure tube relative the guide tube.

23. The vehicle front-end module according to claim 11, wherein the guide tube is made completely from fiber-reinforced plastic.

24. The vehicle front-end module according to claim 11, wherein the guide tube is preferably made completely from fiber-reinforced plastic.

25. The vehicle front-end module according to claim 11, wherein the response behaviour of the energy-absorbing element and/or the amount of a total impact energy to be absorbed by said energy-absorbing element can be predefined by the appropriate selection of the wall thickness and/or rigidity to the energy-absorbing section as well as the structural design of the stop.

26. The vehicle front-end module according to claim 11, wherein an underride guard or rail guard made from fiber composite/fiber composite sandwich material is provided which is attached to the underside of the undercarriage structure and designed to respond upon an exceeding of a critical impact force introduced into the underride guard or rail guard by a controlled deformation of at least one portion of an impact energy occurring upon a transmitting of impact force.

27. A vehicle front-end module having a vehicle front-end structure for mounting to the front end of a rail-borne vehicle, in particular a railway vehicle, wherein the vehicle front-end structure is wholly composed of structural elements made from fiber composite or fiber composite sandwich material, wherein the structural elements forming the vehicle front-end structure comprise first structural elements which are configured and directly connected to one another so as to form a substantially deformation-resistant, self-supporting front-end structure designed to accommodate a vehicle driver's cab, and wherein the structural elements forming the vehicle front-end structure comprise second structural elements connected to the first structural elements and designed such that at least a portion of an impact energy occurring due to a transmitting of impact force and introduced into the structure upon a collision of the rail-borne vehicle is dissipated by at least partly irreversible deformation or at least partial destruction of the second structural elements, wherein an undercarriage structure made from a fiber composite/fiber composite sandwich material is further provided which is connected to at least one part of the first structural elements so as to form the base of the vehicle driver's cab, wherein an underride guard or rail guard made from fiber composite/fiber composite sandwich material is provided which is connected to the underside of the undercarriage structure via at least one guide rail such that the underride guard or rail guard is displaceable in the longitudinal direction of the vehicle relative the undercarriage structure upon an exceeding of a critical impact force introduced into said underride guard or rail guard, and wherein an energy-absorbing element made of fiber-reinforced plastic is further provided which is arranged and designed such that upon the underride guard or rail guard displacing relative the undercarriage structure, the fiber-reinforced plastic of the energy-absorbing element is non-ductilely destroyed with the simultaneous absorbing of at least a portion of an impact energy introduced into said underride guard or rail guard during a transmitting of impact force.

28. The vehicle front-end module according to claim 27, wherein the first structural elements are connected together in a material fit, in particular an adhesive bond.

29. The vehicle front-end module according to claim 27, wherein a windscreen is provided which is connected at least in part to the self-supporting structure of the vehicle front-end module, wherein the windscreen comprises at least one inner and at least one outer transparent surface element arranged at a distance from one another and forming a gap, wherein a transparent energy-absorbing element, in particular a transparent energy-absorbing foam, is provided in the gap and/or wherein a less transparent energy-absorbing element, in particular a transparent energy-absorbing foam, is provided in an edge section of the at least one outer and the at least one inner surface element in the gap.

30. The vehicle front-end module according to claim 29, wherein the at least one outer transparent surface element and/or the at least one inner transparent surface element comprises a plurality of transparent surface elements spaced at a distance from one another by the forming of a plurality of gaps, wherein one connecting element, in particular a transparent energy-absorbing foam, is respectively provided in the plurality of gaps at least at one edge section.

31. Use of a vehicle front-end module according to claim 27 in a rail-born vehicle, in particular a railway vehicle.

32. A rail-borne vehicle, in particular a railway vehicle, which comprises a vehicle front-end module according to claim 27 at the rail-borne vehicle's front end.

* * * * *